United States Patent [19]

McClenning

[11] 4,409,878

[45] Oct. 18, 1983

[54] CARTRIDGE PRIMER SEATING TOOL

[76] Inventor: Gerald E. McClenning, 400 S. St. Charles, Florissant, Mo. 63031

[21] Appl. No.: 285,857

[22] Filed: Jul. 22, 1981

[51] Int. Cl.[3] ..... F42B 33/10

[52] U.S. Cl. ..... 86/36; 86/37; 86/44

[58] Field of Search ..... 86/32, 36, 37, 38, 44, 86/45

[56] References Cited

U.S. PATENT DOCUMENTS

| | | | |
|---|---|---|---|
| 242,775 | 6/1881 | Hobbs | 86/36 |
| 3,082,660 | 3/1963 | Robertson | 86/44 |
| 3,185,019 | 5/1965 | Shoffstall | 86/44 |
| 3,555,959 | 1/1971 | Lee | 86/37 |
| 4,222,305 | 9/1980 | Lee | 86/37 |

FOREIGN PATENT DOCUMENTS

| | | | |
|---|---|---|---|
| 581495 | 11/1924 | France | 86/37 |

*Primary Examiner*—Leland A. Sebastian

[57] ABSTRACT

The present invention relates to a cartridge primer seating tool which combines a seating tool with a primer feed system and includes a housing provided with a shell holder, in combination with primer stem for loading a primer into a shell and a primer dispenser for placing a primer in the primer stem communicating with a cam drive mounted in the housing.

2 Claims, 4 Drawing Figures

CARTRIDGE PRIMER SEATING TOOL

BACKGROUND OF THE INVENTION

Typically, a small arms cartridge which consists of a metallic cartridge case containing propellant is provided at the center of its base with a primer cap containing a small quantity of priming which is exploded by a blow from a firing pin with the primer explosion igniting the propellant causing the bullet to travel.

Small arms enthusiasts in many situations prefer hand loading their cartridges for accuracy, special shooting situations and the like and it is desirable that they have a tool that allows flexibility in loading while at the same time providing repeatability, reliability and safety in an efficient and economical manner.

SUMMARY

It is therefore an object of the present invention to provide a cartridge primer seating device which includes a housing, provided with a cam mounted therein to which are operably coupled a primer stem for forcing the primer into the cartridge case and a primer feed arm for loading primers into the primer stem and feed mechanism.

An object of the present invention is to provide such a device which will permit the operator to load a plurality of primers into the feed mechanism and thereafter by using a single handle provide placing individual primers in an appropriate position to be press fit into the cartridge shell by using the same handle.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein like numerals refer to like parts throughout and in which;

DETAILED DESCRIPTION OF THE INVENTION

Figure 2:
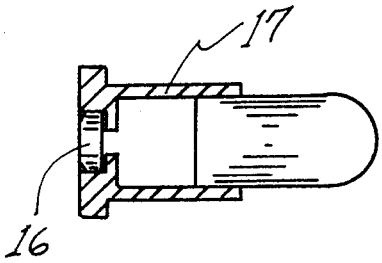
FIG. 2 is a perspective view of a shell and primer used in the device shown in FIG. 1.
Figure 3:
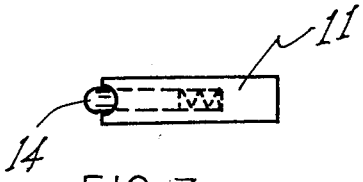
FIG. 3 is an elevation view of the loading tube restrictor used in the device in FIG. 1.
Figure 4A:
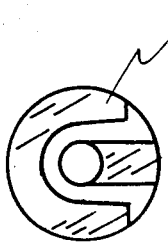
FIG. 4 are two views of a shell holder used in the device in FIG. 1.
Figure 4B:
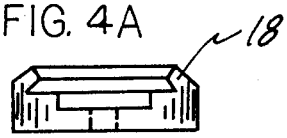
Figure 1:
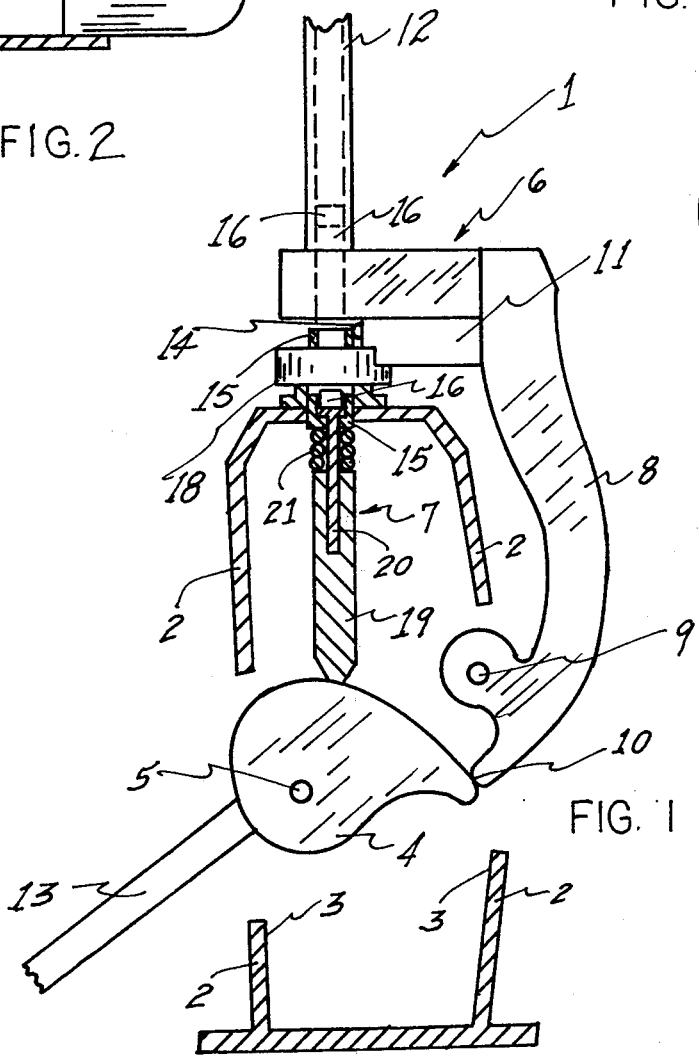
FIG. 1 is an elevation view of a cartridge primer seating device constructed in accordance with and embodying the present invention.

Referring now in more detail and by reference characters to the drawings which illustrate practical embodiments of the present invention, FIG. 1 is an elevation view of a cartridge primer seating device, 1, constructed in accordance with, used in and embodying the present invention.

As shown in FIG. 1, seating device, 1, comprises housing, 2, provided with chamber, 3, cam, 4, rotationally mounted on pin, 5, and disposed partially within chamber, 3, in combination with feed mechanism, 6, and primer stem, 7, operably mounted to and within said housing and communicating with cam, 4.

Feed mechanism, 6, comprises arm, 8, rotationally mounted on pin, 9, with projection, 10, contacting cam, 4, and primer dispensing block, 11, and feed tube, 12. As seen in FIGS. 1, 2, 3, and 4, as arm, 13, is lowered, cam, 4, and projection, 10, cause arm, 8, to rotate counterclockwise about pin, 9, and as pin, 14, which is spring-loaded in block, 11, contacts primer cup, 15, pin, 14, is pushed into block, 11, thereby removing it as a restriction to tube, 12, and allowing a primer, 16, to drop from tube, 12, into primer cup, 15. Arm, 13, is then raised, thus lowering arm, 8, a cartridge shell, 17, is placed into the shell holder, 18, as shown. Arm, 13, is again lowered and primer stem, 7, rises and piston, 20, pushes primer, 16, into shell, 17, which is held in place by shell holder, 18. Primer stem, 7, comprises stem housing, 19, which rides on cam, 4, piston, 20, disposed within stem housing, 7, primer cup, 15, and spring, 21. As piston, 20, and cup, 15, are raised, cup, 15, stops at contact with shell, 17, and piston, 20, continues upward pushing primer, 16, into shell, 17.

It should be understood that changes and modifications in the form, construction, arrangement, and combination of the cartridge primer seating tool device and methods of making and using the same may be made and substituted for those herein shown and described without departing from the nature and principle of my invention.

Having thus described my invention, what I claim is new and desire to secure by United States Letters Patent is:

1. A cartridge primer seating tool comprising, housing means, primer stem means operably mounted in said housing means, primer feed means operably mounted in said housing means, comprising arm means pivotally mounted to said housing means, a primer dispensing block dispensing in cam-controlled and spring-loaded manner primers disposed in a tube disposed vertically above the primer stem means, cam drive means operably communicating with and synchronously driving said primer stem means and said primer feed means.

2. A feed system for cartridge primer seating tool comprising, cam means, linkage means operably communicating with said cam means, primer dispensing means operably mounted on said linkage means comprising a controlled tubular storage member positioned vertically above the primer anvil.

* * * * *